US007138592B2

(12) United States Patent
Lau et al.

(10) Patent No.: US 7,138,592 B2
(45) Date of Patent: Nov. 21, 2006

(54) ELECTRIC ACTUATION DEVICE

(75) Inventors: Christian Lau, Weissach (DE); Klaus-Dieter Baum, Stuttgard (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 0 days.

(21) Appl. No.: 11/153,441

(22) Filed: Jun. 16, 2005

(65) Prior Publication Data

US 2005/0279618 A1 Dec. 22, 2005

(30) Foreign Application Priority Data

Jun. 16, 2004 (DE) ..... 10 2004 029 172

(51) Int. Cl.
*H01H 13/00* (2006.01)
*H01H 3/00* (2006.01)

(52) U.S. Cl. ..... 200/339; 200/5 R; 200/517

(58) Field of Classification Search ..... 200/339
See application file for complete search history.

(56) References Cited

U.S. PATENT DOCUMENTS

| | | | | |
|---|---|---|---|---|
| 3,081,390 | A | 3/1963 | Lasar | |
| 5,557,080 | A | 9/1996 | Hayakawa | |
| 5,584,380 | A | 12/1996 | Naitou | 200/315 |
| 6,686,550 | B1 * | 2/2004 | Seki et al. | 200/553 |
| 6,737,592 | B1 * | 5/2004 | Hoang et al. | 200/1 B |
| 2002/0104742 | A1 * | 8/2002 | Novelle et al. | 200/5 R |
| 2006/0054475 | A1 * | 3/2006 | Galvin et al. | 200/5 R |

FOREIGN PATENT DOCUMENTS

| | | | |
|---|---|---|---|
| DE | 4104572 | A1 | 8/1991 |
| DE | 4415665 | A1 | 11/1995 |
| DE | 10156437 | A1 | 6/2002 |
| DE | 10159856 | A1 | 7/2002 |
| DE | 102 06 777 | A1 | 9/2003 |

OTHER PUBLICATIONS

European Search Report, dated Sep. 8, 2005 Three (3) w/English translation of relevant portion.

* cited by examiner

*Primary Examiner*—Elvin Enad
*Assistant Examiner*—Lheiren Mae A. Anglo
(74) *Attorney, Agent, or Firm*—Crowell & Moring LLP

(57) ABSTRACT

An electric operating part assembly has a switching mat and switching mat domes which are arranged therein and which can be operated by the effect of a vertical force. The operating part has at least one pull rocker which, in its longitudinal course, is arranged parallel to the surface of the switching mat. When the pull rocker is operated, a switching arm of the pull rocker situated opposite the operating arm will move a ram arranged between the switching arm and the switching mat dome, for operating the switching mat dome, in the direction of the switching mat dome.

5 Claims, 1 Drawing Sheet

ELECTRIC ACTUATION DEVICE

BACKGROUND AND SUMMARY OF THE INVENTION

This application claims the priority of German Application No.: 10 2004 029 172.1-34 filed on Jun. 16, 2004, the disclosure of which is expressly incorporated by reference herein.

The present invention is based on an electric operating part, as known, for example, from German Patent Document DE 44 15 665 A1.

This German Patent Document DE 44 15 665 A1 describes an operating part for an electric apparatus with a front panel, in which switching keys are arranged which can be swivelled about a first swivel bearing, and with key parts situated behind the front panel. When these key parts are pressed in, switching points are operated which are arranged behind the front panel. Furthermore, a converter lever is provided between a switching key and the switching point and carries out a mediator function in that it converts a possibly excessively steep setting angle of the switching key to a very low setting angle at the switching mat.

In the case of the operating part according to the invention, as a result of the arrangement of switching mats in combination with pull rockers, the possibility is created of producing the operating part by means of simple technological devices, which causes low tool costs and permits a simple and space-saving assembly. It is known that a switching mat is constructed such that electric contacts, which are also called switching mat domes, are provided in the flat mat, the operating of the switching mat domes taking place by a pressure onto these switching mat domes, so that the electric contact is closed and the desired function is switched on and/or off. The implementation of the operations of the switching mat domes by means of pull rockers permits the exercising of a vertically acting pressure onto the switching mat domes, whereby a point-accurate operation is ensured. Furthermore, this arrangement has the advantage that only a few moving parts and no additional deflecting mechanisms, as described in the prior art, are required. This significantly improves the haptics and the service life and provides for a faster and process-reliable manufacturing. Another advantage of the arrangement according to certain preferred embodiments of the invention is the fact two identical pull rockers can be arranged opposite one another at a narrow distance.

The operating part according to the invention is illustrated in the drawing and will be explained in detail in the following.

Additional details of preferred embodiments of the invention are characterized in the claims.

An embodiment of the invention is illustrated in the drawings and will be described in detail in the following.

DETAILED DESCRIPTION OF THE DRAWINGS

Figure 1:
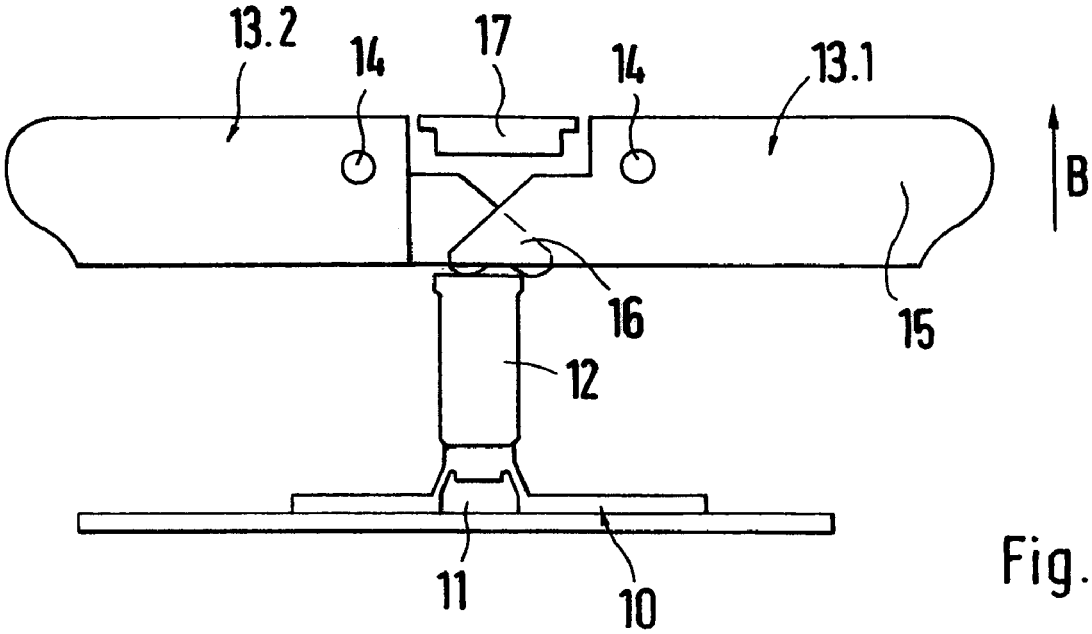
FIG. 1 is a lateral view of an operating part constructed according to preferred embodiments of the invention.

FIG. 1 is a lateral view of the operating part according to the invention, the interaction of a switching mat with at least one pertaining tension rocker 13 being explained here. In the example shown, the switching mat has the reference number

10. These switching mats 10 are sufficiently known in the state of the art and will not be explained here in detail. However, it is significant that these switching mats 10 have switching mat domes 11 which have the function of an electric switch.

Two pull rockers are arranged in FIG. 1, indicated by the reference number for a first pull rocker 13.1 and for a second pull rocker 13.2. The arrangement of the pull rocker in its working relationship with respect to the switching mat is independent of whether one or two pull rockers are provided. However, it is an advantage of the constructive design of the pull rockers, which will be explained below, that two pull rockers can be arranged in a very space-saving manner with respect to one another and with respect to the switching mat. Furthermore, for reasons of simplicity, the description of the function of the pull rocker will relate to only one pull rocker.

In their longitudinal course, the pull rockers 13 are arranged parallel to the switching mat 10 and are designed such that their respective axes of rotation 14 are laterally displaced. The axis of rotation 14 divides the pull rocker into an operating arm 15 and a switching arm 16. Because of the eccentric location of the axis of rotation 14, the operating arm 15 is longer than the switching arm 16. When the operating arm 15 is operated in the direction of the arrow B in FIG. 1, the switching arm 16 of the pull rocker 13 is moved in the direction of the switching mat dome 11.

For a targeted force transmission to the switching mat dome 11, a ram 12 is arranged between the switching arm 16 and the switching mat dome 11, which ram 12 transmits the movement of the switching arm 16 as vertical pressure upon the switching mat dome 11.

Figure 2:
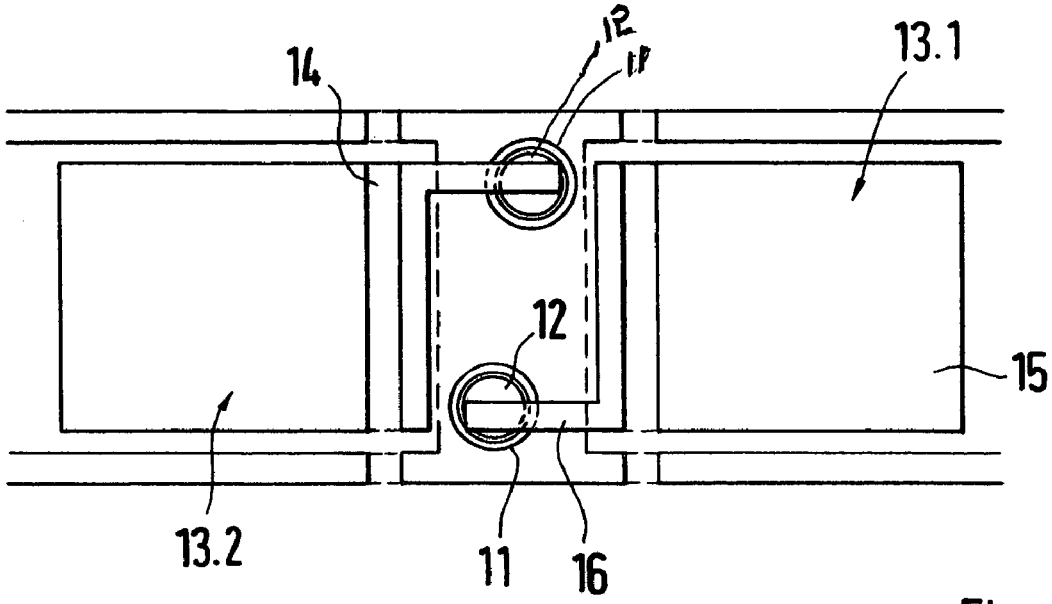
FIG. 2 is a top view of the operating part of FIG. 1.

Another characteristic of the constructive design is to be explained by means of FIG. 2, in which case, in FIGS. 1 and 2, identical components are provided with the same reference number. FIG. 2 is a schematic top view of the electric operating part with its arrangement of two pull rockers 13.1 and 13.2 with respect to the contacts 11 of the switching mat 10.

On the side of the switching arm 16, the pull rockers are offset with respect to the operating arm 15, which is easily visible in FIG. 2. As a result, it becomes possible to arrange the two pull rockers 13 opposite one another such that the two switching arms are situated closely side-by-side, whereby a space-saving arrangement is obtained and, in addition, even switching mat domes 11 which are situated close to one another on a switching mat 10 can easily be operated.

The area in which the switching arms 16 of the pull rockers are situated side-by-side is advantageously covered by a panel 17, as illustrated in FIG. 1.

The arrangement of the pull rockers with an eccentrically arranged axis of rotation permits an operation of the switching mat domes with only a few moving parts and with no additional deflecting mechanisms. As a result, the haptics and the service life can clearly be improved, and a positive influence exists on the tolerances in the system.

The use of the ram ensures a vertical introduction of force into the switching mat and a partitioning off of the electronic system against harmful environmental influences.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Electric operating part, comprising a switching mat and switching mat domes which are arranged therein and which can be operated by the effect of a vertical force, two pull rockers which, in their respective longitudinal course, are arranged parallel to the surface of the switching mat such that, during operation of the pull rocker, a switching arm of the pull rocker situated opposite an operating arm moves a ram arranged between the switching arm and the switching mat dome for operating the switching mat dome in the direction of the switching mat dome, wherein the two pull rockers are arranged parallel to the switching mat, and are situated opposite one another, the axes of rotation of the two pull rockers being situated close to one another, the switching arm is offset with respect to the operating arms, and the two pull rockers with their switching arms are arranged with respect to one another such that the two switching arms are situated closely side-by-side over the switching mat.

2. Electric operating part according to claim 1, wherein each pull rocker has an eccentrically arranged axis of rotation, the longer part of the pull rocker starting out from the axis of rotation being the operating arm and the shorter part of the pull rocker being the switching arm.

3. Electric operating part according to claim 1, wherein the operating arm is larger than the switching arm.

4. Electric operating part according to claim 1, wherein said pull rockers and ram are adjacent one another and said switching mat dome is activated by said ram.

5. Electric operating part according to claim 4, wherein the switching arm is offset with respect to the operating arm.

* * * * *